US009200385B2

(12) United States Patent
Dambrine et al.

(10) Patent No.: US 9,200,385 B2
(45) Date of Patent: Dec. 1, 2015

(54) JACQUARD LOOM HAVING OPTIMIZED WARP YARN DENSITY

(71) Applicants: SNECMA, Paris (FR); ALBANY ENGINEERED COMPOSITES, Rochester, NH (US)

(72) Inventors: Bruno Jacques Gerard Dambrine, Le Chatelet en Brie (FR); Dominique Coupe, Le Haillan (FR); Ken Ouellette, Kennebunk, ME (US); Jonathan Goering, York, ME (US)

(73) Assignees: SNECMA, Paris (FR); ALBANY ENGINEERED COMPOSITES, Rochester, NH (US)

( * ) Notice: Subject to any disclaimer, the term of this patent is extended or adjusted under 35 U.S.C. 154(b) by 0 days.

(21) Appl. No.: 14/365,018

(22) PCT Filed: Dec. 10, 2012

(86) PCT No.: PCT/FR2012/052849

§ 371 (c)(1),
(2) Date: Jun. 12, 2014

(87) PCT Pub. No.: WO2013/088037

PCT Pub. Date: Jun. 20, 2013

(65) Prior Publication Data

US 2015/0114511 A1 Apr. 30, 2015

Related U.S. Application Data

(60) Provisional application No. 61/570,422, filed on Dec. 14, 2011.

(51) Int. Cl.
*D03C 3/38* (2006.01)
*D03C 3/00* (2006.01)
(Continued)

(52) U.S. Cl.
CPC *D03C 3/38* (2013.01); *D03D 41/00* (2013.01); *D03D 41/004* (2013.01)

(58) Field of Classification Search
CPC ... D03D 25/005; D03D 41/004; D03D 41/00; D03D 49/46; D03D 11/00; D03D 2700/16; D03D 37/00; Y10S 139/01; D03C 13/00; D03C 3/40; D03C 3/20; D03C 3/205; D03C 3/32; D03C 7/00; D03C 3/38; D03C 3/44; D01B 2505/02
See application file for complete search history.

(56) References Cited

U.S. PATENT DOCUMENTS 2,704,557 A * 3/1955 Moberg ..... 139/50
3,749,138 A * 7/1973 Rheaume et al. ..... 139/408
(Continued)

FOREIGN PATENT DOCUMENTS

EP 1 526 285 4/2005

OTHER PUBLICATIONS

International Search Report Issued Nov. 20, 2013 in PCT/FR12/052849 Filed Dec. 10, 2012.

*Primary Examiner* — Bobby Muromoto, Jr.
(74) *Attorney, Agent, or Firm* — Oblon, McClelland, Maier & Neustadt, L.L.P.

(57) ABSTRACT

A jacquard type loom for making a fabric by weaving plural warp yarns with plural weft yarns, the fabric including a determined number of columns of warp yarns per unit length and a determined number of layers of weft yarns. The loom includes a comber board including plural holes passing a corresponding number of control cords, each control cord including an heddle eye through which a warp yarn passes. The holes are distributed in a determined number of columns extending parallel to the warp yarn direction and a determined number of rows per column extending in a direction perpendicular to the warp yarn direction. The comber board includes a number of columns of holes per unit length smaller than the number of warp columns in the same unit length in the fabric, and a number of rows of holes greater than the number of warp layers in the fabric.

6 Claims, 7 Drawing Sheets

(51) Int. Cl.
*D03D 41/00* (2006.01)
*D03C 13/00* (2006.01)

(56) References Cited

U.S. PATENT DOCUMENTS 4,057,084 A * 11/1977 Mueller ..... 139/59
4,513,789 A * 4/1985 Bowen et al. ..... 139/85
6,769,458 B2 * 8/2004 Froment ..... 139/59
7,007,721 B2 * 3/2006 Bassi et al. ..... 139/59
7,077,167 B2 * 7/2006 Nayfeh et al. ..... 139/11
7,101,154 B2 * 9/2006 Dambrine et al. ..... 416/230
7,241,112 B2 * 7/2007 Dambrine et al. ..... 415/230
2005/0084377 A1 4/2005 Dambrine et al.
2005/0103394 A1 * 5/2005 Bassi et al. ..... 139/59
2005/0274426 A1 * 12/2005 Nayfeh et al. ..... 139/11
2006/0257260 A1 * 11/2006 Dambrine et al. ..... 416/230
2010/0269948 A1 * 10/2010 Legrand et al. ..... 139/384 R
2010/0319801 A1 * 12/2010 Legrand et al. ..... 139/11
2011/0110787 A1 * 5/2011 Belmonte et al. ..... 416/223 R
2011/0318513 A1 * 12/2011 Marsal et al. ..... 428/35.7
2013/0017093 A1 * 1/2013 Coupe et al. ..... 416/230
2013/0272893 A1 * 10/2013 Fabre et al. ..... 416/226
2014/0334935 A1 * 11/2014 Dambrine et al. ..... 416/223 A
2014/0369847 A1 * 12/2014 Dambrine et al. ..... 416/230

* cited by examiner

JACQUARD LOOM HAVING OPTIMIZED WARP YARN DENSITY

BACKGROUND OF THE INVENTION

The present invention relates to a jacquard type loom.

FIG. 1 is a diagram of a jacquard type loom 10 used for making fiber structures or fabric obtained by multilayer weaving between a plurality of layers of warp yarns 30 and a plurality of layers of weft yarns 31.

In known manner, the loom 10 is fitted with a jacquard mechanism 11 supported by a superstructure that is not shown in FIG. 1. The loom 10 also has a harness 20 constituted by a comber board 21 and control cords or heddles 22, each heddle 22 being connected at one end to a control hook 12 of the jacquard mechanism 11 and at the other end to one of the return springs 13 fastened to the base 14 of the loom 10.

Each heddle 22 includes a heddle eye 23 having a warp yarn 30 passing therethrough. The heddles 22 and their associated heddle eyes 23 are driven in substantially vertical reciprocating motion represented by double-headed arrow F under traction forces exerted respectively by the control hooks 12 and by the return springs 13. The heddles 22 serve to lift certain warp yarns 30, thereby creating a shed 15 enabling weft yarns 31 to be inserted.

The heddles 22 are distributed in space as a function of the positions of the holes 210 of the comber board 21, i.e. in a plurality of columns 211 and rows 212.

The density of the holes 210 in the comber board corresponds to the density in the fabric to be made, i.e. the spacing between each of the columns of holes in the comber board is equivalent to the spacing that is presented between each of the warp columns in the fabric that is to be made.

Certain fiber structures, e.g. such as those for constituting the reinforcement of aeroengine blades made of composite material, require weaving that is very dense, with a thread count, and in particular a warp thread count, that is relatively tight in order to confer good mechanical strength to the part. The warp thread count corresponds to the number of warp yarns per unit length. Consequently, when it is desired to weave with a tighter thread count, it is necessary to reduce the spacing between the columns of holes in the comber board, thereby causing the heddles of a column, e.g. the heddles 22 of the column l1 to be closer to the heddles of the adjacent column(s), e.g. here the column l2. Nevertheless, when the heddles of two adjacent columns are too close together, then the movements of the heddles, and more particularly of their associated heddle eyes, are impeded by the proximity of the heddles and of the warp yarns present in the adjacent column.

In order to avoid any risk of catching between heddles belonging to adjacent columns, it is necessary to ensure some minimum amount of spacing between the heddle columns. There is thus a limit on the extent to which the density of the thread count of a fabric can be increased with existing looms.

OBJECT AND SUMMARY OF THE INVENTION

Consequently, it is desirable to be able to have looms that enable fabrics to be made that present a thread count that is greater than that which can be obtained with prior art looms.

To this end, the invention provides a jacquard tune loom for making a fabric by weaving a plurality of warp yarns with a plurality of weft yarns, the fabric comprising a determined number of columns of warp yarns per unit length and a determined number of layers of weft yarns, said loom including a comber board having a plurality of holes for passing a corresponding number of control cords, each control cord being provided with a heddle eye through which there passes a warp yarn, the holes in the comber board being distributed in a determined number of columns extending parallel to the warp yarn direction and a determined number of rows per column extending in a direction perpendicular to the warp yarn direction, the loom being characterized in that the comber board has a number of columns of holes per unit length that is smaller than the number of warp columns in the same unit length in the fabric, and a number of rows of holes that is greater than the number of warp layers in the fabric.

By reducing the number of columns of holes in the comber board relative to the number of columns of warp yarns in the fabric that is to be made, it becomes possible to maintain spacing between the columns of adjacent heddles that is sufficient to avoid impeding their respective movements, while nevertheless making a fabric with a warp thread count that is tighter than that which can be obtained using a prior art loom.

Furthermore, since the number of holes per column of holes in the comber board is greater than the number of warp layers in the fabric that is to be made, there are sufficient warp yarns to form the desired density of columns and the desired number of layers of warp yarns in the fabric that is to be made.

In other words, a portion of the warp thread count density that is desired in the fabric that is to be made is spread in the depth direction of the comber board in order to retain sufficient spacing between adjacent heddle columns.

According to an aspect of the invention, the number of columns of holes per unit length in the comber board is determined as a function of the number of warp columns in the same unit length in the fabric, and the number of rows of holes is determined as a function of the number of warp yarn layers in the fabric. It is thus possible to optimize the distribution of the holes in the comber board as a function of the thread count density desired for the fabric that is to be made.

In a first example of distribution, the number of columns of holes in the comber board corresponds to the determined number of columns of warp yarns per unit length in the fabric divided by 1.5, and the number of rows of holes corresponds to the number of layers of warp yarns in the fabric multiplied by 1.5.

In a second example of distribution, the number of columns of holes in the comber board corresponds to the determined number of columns of warp yarns per unit length in the fabric divided by 2, and the number of rows of holes corresponds to the number of layers of warp yarns in the fabric multiplied by 2.

According to another aspect of the invention, the loom includes a comb located downstream from the control cords in the direction of advance of the warp yarns, the spacing distance between two adjacent teeth of said comb corresponding to a distance that serves to pass a number of warp yarns between two teeth of the comb that corresponds to a divisor of the number of columns of holes per said unit length in the comber board and to a divisor of the number of warp columns per said unit length in the fabric.

This makes it possible to maintain warp yarn layers belonging to a given warp column between two adjacent teeth of the comb, thereby organizing the columns and layers of warp yarns depending on the numbers of columns and layers of warp yarns that are defined for the fabric.

The invention also provides the use of the loom of the invention for making fiber structures for reinforcing composite material blades for aeroengines.

BRIEF DESCRIPTION OF THE DRAWINGS

Other characteristics and advantages of the invention appear from the following description of particular embodiments of the invention, given as non-limiting examples and with reference to the accompanying drawings, in which.

DETAILED DESCRIPTION OF EMBODIMENTS

The invention applies in general to the jacquard type looms that are used in particular for making fiber textures or fabrics by multilayer weaving between layers of warp yarns and layers of weft yarns. The invention applies more particularly to weaving fabrics that present a tight thread count, i.e. a large number of warp and/or weft yarns per unit length. Thread count is generally expressed as a number of yarns per centimeter or per inch.

As explained above, above a certain level of warp yarn density, expressed in terms of thread count, weaving becomes very difficult, or even impossible, since the heddle eyes of a heddle column are too close to the heddle eyes and to the warp yarns of the adjacent heddle column(s).

To this end, the invention proposes distributing the density of the yarns for weaving in the depth direction of the comber board of the loom, thus making it possible to increase the spacing between two heddle columns, while conserving a subsequent high density in the fabric. It is thus possible to weave with a warp yarn density in the fabric that is greater than the maximum density that is possible with a prior art loom.

More precisely, in the present invention, the comber board has a number of columns and holes per unit length that is less than the number of warp columns for the same unit length in the fabric, and a number of rows of holes that is greater than the number of warp layers in the fabric. The number of columns of holes is determined as a function of the warp thread count of the fabric, and the number of rows of holes is determined as a function of the number of layers of the fabric.

For example, the number of columns of holes in the comber board may correspond to the warp thread count of the fabric divided by 1.5, while the number of rows of holes corresponds to the number of layers of warp yarns in the fabric multiplied by 1.5. In another example, the number of columns of holes in the comber board may correspond to the warp thread count of the fabric divided by 2, while the number of rows of holes corresponds to the number of warp yarn layers of the fabric multiplied by 2.

Figure 1:
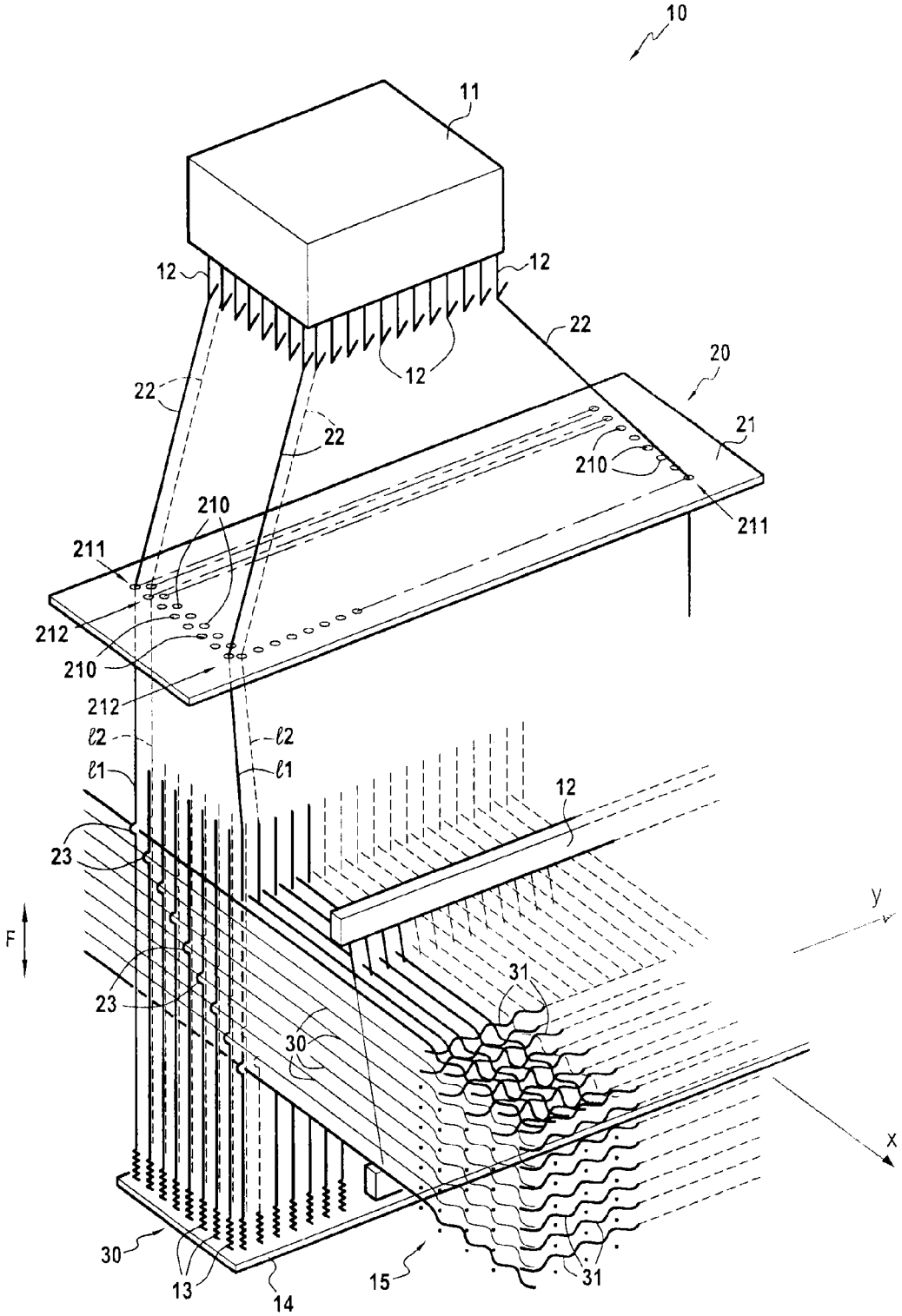
FIG.1 PRIOR ART
FIG. 1 is a diagrammatic perspective view of a prior art jacquard type loom.
Figure 2:
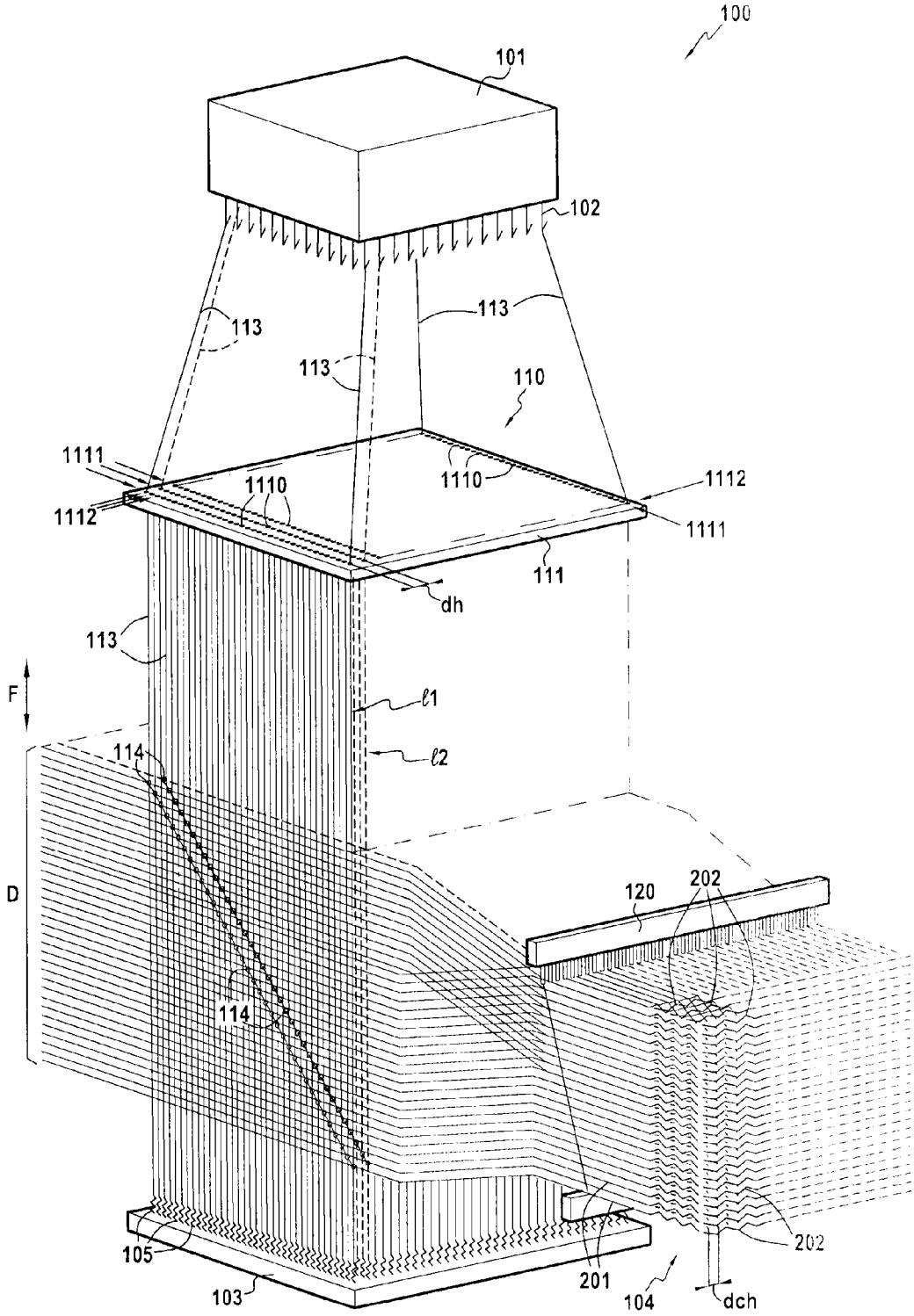
FIG. 2 is a diagrammatic perspective view of a jacquard type loom in an embodiment of the invention.

FIG. 2 shows a loom 100 fitted with a jacquard mechanism 101 supported by a superstructure that is not shown in FIG. 2. The loom 100 also has a harness 110 constituted by a comber board ill and by control cords or heddles 113, each heddle 113 being connected at one end to a control hook 102 of the jacquard mechanism 101 and at the other end to one of the return springs 105 fastened to the base 103 of the loom 100. Each heddle 113 has a heddle eye 114 through which there passes a warp yarn 201. The heddles 113 and their associated heddle eye 114 extend through a zone D in which the heddles 113 and the heddle eyes 114 are driven with substantially vertical reciprocating motion represented by double-headed arrow F. The heddles 113 are subjected to traction forces exerted respectively by the control hooks 102 and by the return springs 105. The heddles 113 serve to lift certain warp yarns 201, thereby creating a shed 104 enabling weft yarns 202 to be inserted.

The heddles 113 are distributed in space in the zone D as a function of the positions of the holes 1110 in the comber board 111, i.e. as a plurality of columns 1111 of holes 1110 and as a plurality of rows 1112 of holes 1110. As explained below in detail, the warp yarns 201 situated downstream from the comb 120 are grouped at a number of columns per unit length that is greater than that of the comber board and a number of layers that is less than the number of rows of holes in the comber board so as to correspond to the final density of the fabric that is to be made.

In the example shown in FIG. 2, the loom 100 serves to weave a fabric having a warp thread count of 12 yarns per inch, i.e. 4.7 yarns per centimeter, over 24 warp layers in the thickness of the fabric. In accordance with the invention and in the example described herein, the loom 100 has a harness 110 fitted with a comber board ill presenting 12/1.5=8 columns of holes per inch, i.e. 3.1 columns per centimeter, each extending over 24×1.5=36 rows of holes. Consequently, the distance $d_h$ between adjacent columns 1111 of holes 1110 in the comber board 111 corresponds to 1.5 times the distance $d_{ch}$ between adjacent warp columns present in the shed 104, thereby making it possible to have spacing that is greater between pairs of columns of heddles. The heddle eyes in a heddle column can then move freely, i.e. without being hindered by being too close to the warp yarns or the heddle eyes of the adjacent heddle column(s).

Figure 3:
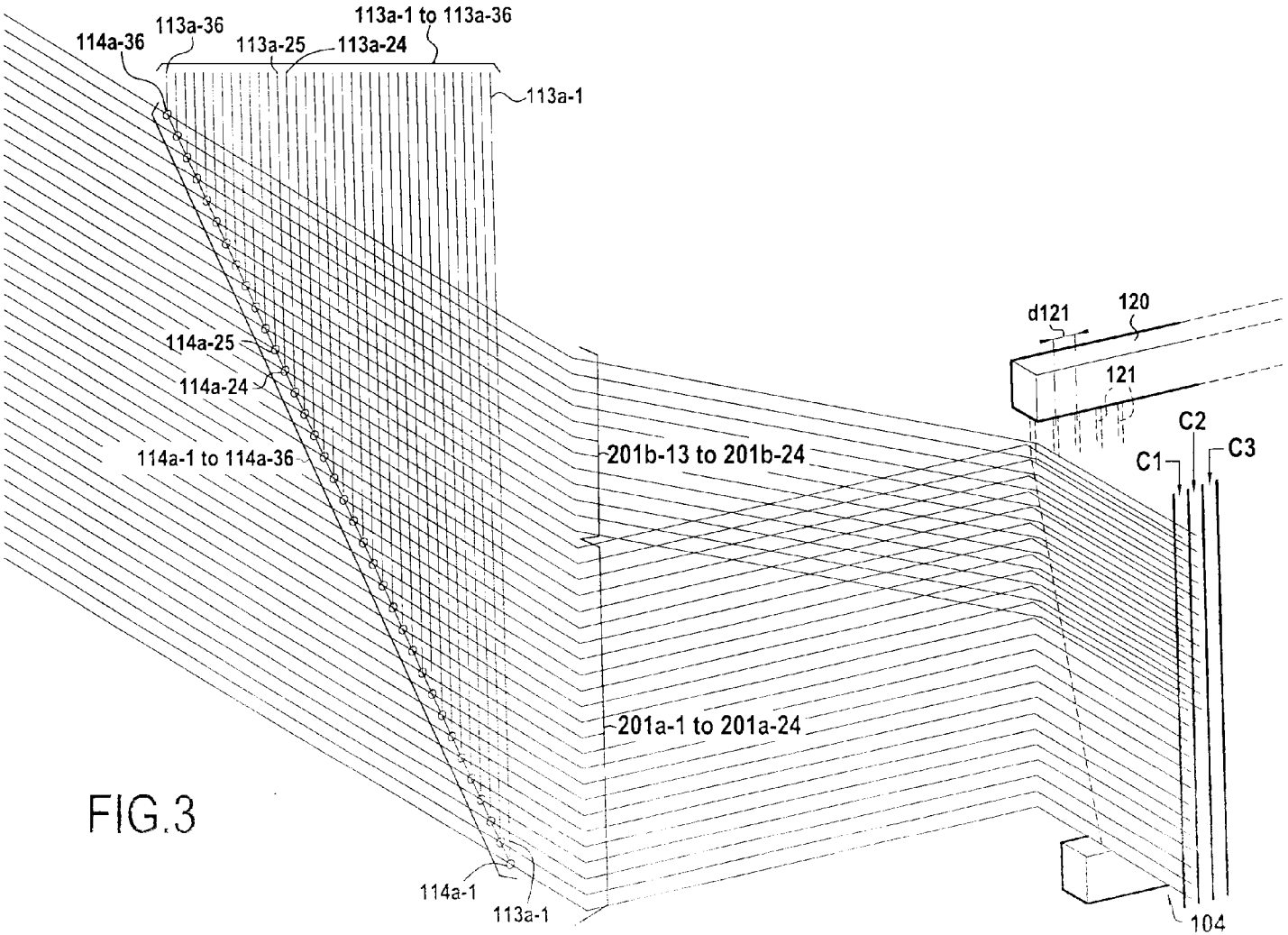
FIG. 3 is a theoretical diagram showing the distribution prior to weaving of warp yarns from a first column of heddles of the FIG. 2 loom.
Figure 4:
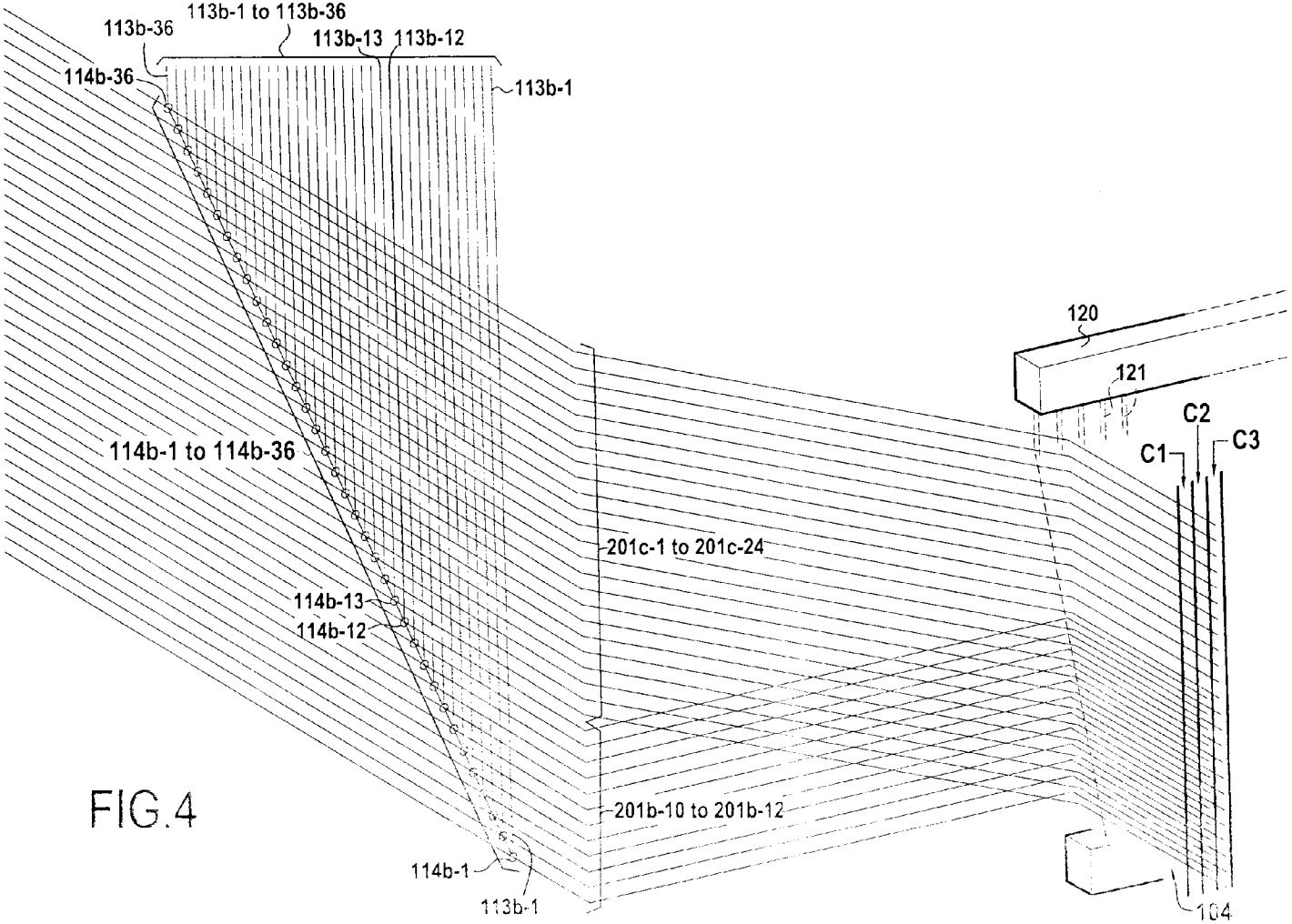
FIG. 4 is a theoretical diagram showing the distribution prior to weaving of warp yarns from a second heddle column that is adjacent to the first heddle column of the FIG. 2 loom.

For reasons of simplification and clarity in FIG. 2, only two columns of heddles 113 and of associated warp yarns 201 are actually shown beneath the harness 110. More precisely, and as shown in FIG. 3, the first heddle column l1 has 36 heddles 113*a*-1 to 113*a*-36, each having a example heddle eye 114*a*-1 to 114*a*-36 through which there passes a respective warp yarn 201*a*-1 to 201*a*-24 and 201*b*-13 to 201*b*-24. As shown in FIG. 4, the second heddle column l2 has 36 heddles 113*b*-1 to 113*b*-36 each having a respective heddle eye 114*b*-1 to 114*b*-36 through which there passes a respective warp yarn 201*b*-1 to 201*b*-12 and 201*c*-1 to 201*c*-24.

FIG. 3 shows how the warp yarns from the first heddle column l1 are distributed downstream from the comb 120, i.e. in the shed 104. The first 24 warp yarns 201*a*-1 to 201*a*-24 passing respectively through the heddle eyes 114*a*-1 to 114*a*-24 associated respectively with the heddles 113*a*-1 to 113*a*-24 form the first column C1 of warp yarns in the shed 104 while the last 12 warp yarns 201*b*-13 to 201*b*-24 passing respectively through the heddle eyes 114*a*-25 to 114*a*-36 associated respectively with the heddles 113*a*-25 to 113*a*-36 form a portion of the second column C2 of warp yarns in the shed 104.

FIG. 4 shows how the warp yarns from the second heddle column l2 are distributed downstream from the comb 120, i.e. in the shed 104. The first 12 warp yarns 201*b*-1 to 201*b*-12 passing respectively through the heddle eyes 114*b*-1 to 114*b*-12 associated respectively with the heddles 113*b*-1 to 113*b*-12 form the other portion of the second column C2 of warp yarns in the shed 104, while the last 24 warp yarns 201*c*-1 to 201*c*-24 passing respectively through the heddle eyes 114*b*-

13 to 114*b*-36 associated respectively with the heddles 113*b*-13 to 113*b*-36 form the third column C3 of warp yarns in the shed 104.

The following table shows how the warp yarns are taken in the harness.

| Heddle eye | 1st column in the harness | Heddle eye | 2nd column in the harness |
|---|---|---|---|
| 114a-36 | 201b-24 | 114b-36 | 201c-24 |
| 114a-35 | 201b-23 | 114b-35 | 201c-23 |
| 114a-34 | 201b-22 | 114b-34 | 201c-22 |
| 114a-33 | 201b-21 | 114b-33 | 201c-21 |
| 114a-32 | 201b-20 | 114b-32 | 201c-20 |
| 114a-31 | 201b-19 | 114b-31 | 201c-19 |
| 114a-30 | 201b-18 | 114b-30 | 201c-18 |
| 114a-29 | 201b-17 | 114b-29 | 201c-17 |
| 114a-28 | 201b-16 | 114b-28 | 201c-16 |
| 114a-27 | 201b-15 | 114b-27 | 201c-15 |
| 114a-26 | 201b-14 | 114b-26 | 201c-14 |
| 114a-25 | 201b-13 | 114b-25 | 201c-13 |
| 114a-24 | 201a-24 | 114b-24 | 201c-12 |
| 114a-23 | 201a-23 | 114b-23 | 201c-11 |
| 114a-22 | 201a-22 | 114b-22 | 201c-10 |
| 114a-21 | 201a-21 | 114b-21 | 201c-9 |
| 114a-20 | 201a-20 | 114b-20 | 201c-8 |
| 114a-19 | 201a-19 | 114b-19 | 201c-7 |
| 114a-18 | 201a-18 | 114b-18 | 201c-6 |
| 114a-17 | 201a-17 | 114b-17 | 201c-5 |
| 114a-16 | 201a-16 | 114b-16 | 201c-4 |
| 114a-15 | 201a-15 | 114b-15 | 201c-3 |
| 114a-14 | 201a-14 | 114b-14 | 201c-2 |
| 114a-13 | 201a-13 | 114b-13 | 202c-1 |
| 114a-12 | 201a-12 | 114b-12 | 201b-12 |
| 114a-11 | 201a-11 | 114b-11 | 201b-11 |
| 114a-10 | 201a-10 | 114b-10 | 201b-10 |
| 114a-9 | 201a-9 | 114b-9 | 201b-9 |
| 114a-8 | 201a-8 | 114b-8 | 201b-8 |
| 114a-7 | 201a-7 | 114b-7 | 201b-7 |
| 114a-6 | 201a-6 | 114b-6 | 201b-6 |
| 114a-5 | 201a-5 | 114b-5 | 201b-5 |
| 114a-4 | 201a-4 | 114b-4 | 201b-4 |
| 114a-3 | 201a-3 | 114b-3 | 201b-3 |
| 114a-2 | 201a-2 | 114b-2 | 201b-2 |
| 114a-1 | 201a-1 | 114b-1 | 201b-1 |

The warp yarns from the heddle columns are deflected and organized by the comb 120 to occupy the numbers of columns and layers of warp yarns that are defined for the fabric. Thus, for three columns of 36 heddles in the zone D, there can be found in the shed 104 three columns of 24 warp yarns, i.e. a first column of yarns 201*a*-1 to 201*a*-24, a second column of yarns 201*b*-1 to 201*b*-24, and a third column of yarns 201*c*-1 to 201*c*-24, thereby obtaining, in the location where the warp yarns 201 are woven with the weft yarns 202, the density of warp yarns that is desired for the fabric.

According to an aspect of the invention, the spacing distance between two adjacent teeth of the comb preferably corresponds to a distance that allows a number of warp yarns to pass between two teeth of the comb that corresponds to a divisor of the number of columns of holes per unit length in the comber board and to a divisor of the number of warp columns in the same unit length in the fabric. In the example described with reference to FIGS. 2 to 4, the distance d121 between two adjacent teeth 121 of the comb 120 corresponds to the distance between two columns 1111 of holes 1110 in the comber board 111 divided by 2 (8/2=4) and to the distance $d_{ch}$ between two warp columns in the fabric divided by 3 (12/3=4), with three columns of warp yarns being present between two adjacent teeth 121 of the comb 120.

Figure 5:
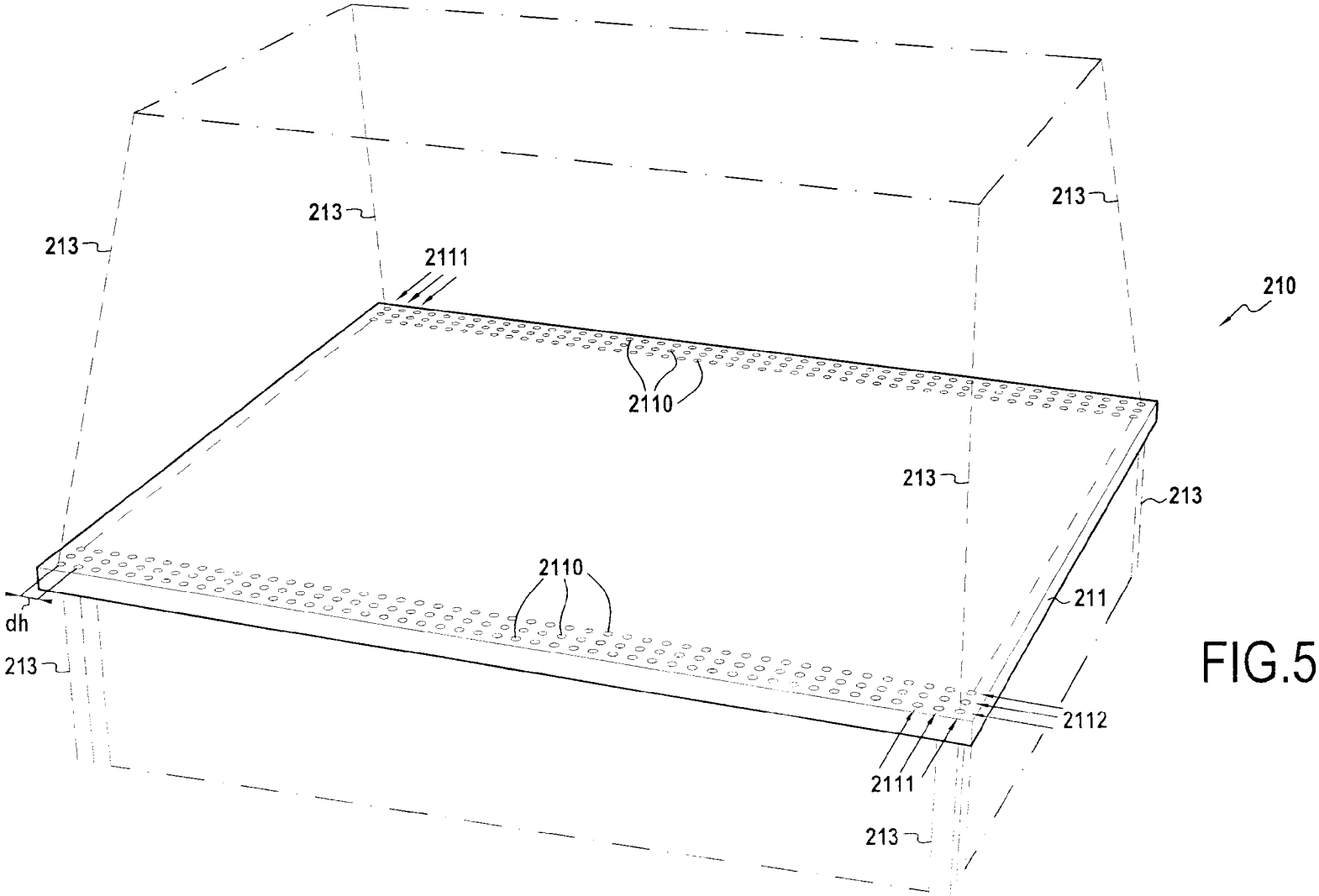
FIG. 5 is a diagrammatic perspective view of a comber board in another embodiment of the invention.

FIG. 5 shows a harness 210 constituted by a comber board 211 that differs from the comber board 111 of FIG. 2 in that it likewise makes it possible to weave a fabric having a warp thread count of 12 yarns per inch, i.e. 4.7 yarns per centimeter, over 24 warp layers in the thickness of the fabric, but using heddle columns each comprising 48 heddles and associated heddle eyes, with every other heddle eye being used in each heddle column. For reasons of simplification, only the comber board 211 of the loom is shown in FIG. 5, the other elements of the loom being identical to those of FIG. 2, taking account of the increase in the number of heddles per column together with their associated heddle eyes.

In the example described herein, the number of columns of holes in the comber board corresponds to the warp thread count of the fabric divided by 2, whereas the number of rows of holes corresponds to the number of layers of warp yarns in the fabric multiplied by 2. More precisely, the comber board 211 presents 12/2=6 columns of holes per inch, i.e. 2.36 columns per centimeter, each extending over 24×2=48 rows of holes. Consequently, the distance $d_h$ between two columns 2111 of holes 2110 in the comber board 211 corresponds to twice the distance between two warp columns present in the shed, thus making it possible to have greater spacing between two heddle columns. The heddle eyes of a heddle column can then move freely, i.e. without being hindered by being too close to the warp yarns or the heddle eyes of the adjacent heddle column(s).

In addition, as described in detail below, a warp yarn is made to pass through only every other heddle eye in each heddle column, with an offset between two adjacent heddle columns, thereby enabling the heddle eyes that serve to raise the warp yarns to be spaced even further apart from one another.

The heddles 213 are distributed in space as a function of the positions of the holes 2110 in the comber board 211, i.e. as a plurality of columns 2111 of holes 2110 and of rows 2112 of holes 2110.

Figure 6:
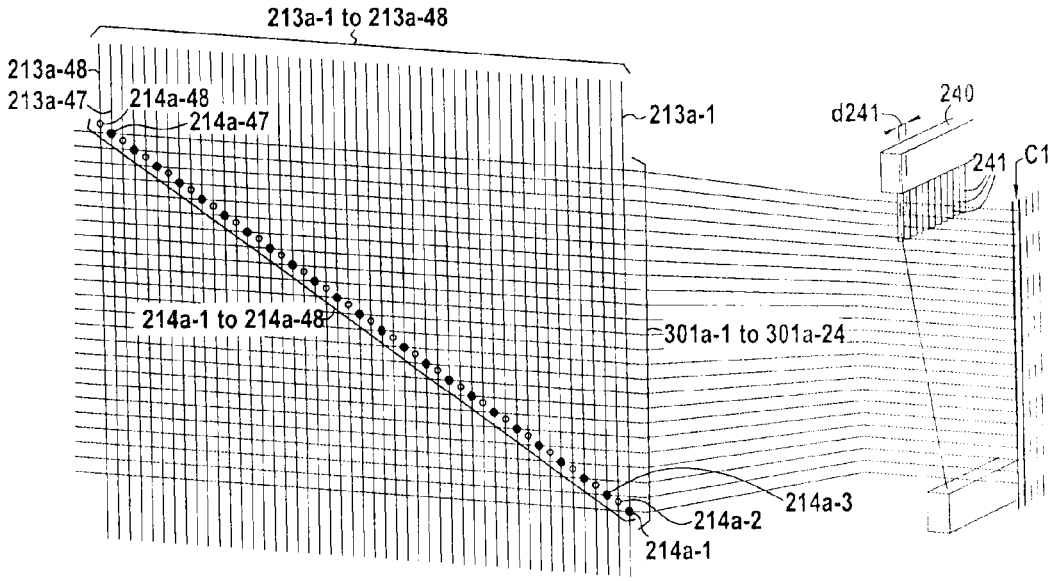
FIGS. 6 to 9 are theoretical views showing the distribution prior to weaving of warp yarns coming respectively from first, second, third, and fourth columns of heddles co-operating with the FIG. 5 comber board.

FIG. 6 shows how the warp yarns are distributed in the first column of heddles 213*a*-1 to 213*a*-48. The 24 warp yarns 301*a*-1 to 301*a*-24 pass through respective heddle eyes 214*a*-1, 214*a*-3, . . . to 214*a*-47 associated respectively with the heddles 213*a*-1, 213*a*-3, . . . , to 213*a*-47 so as to form the first column C1 of warp yarns in the shed.

Figure 7:
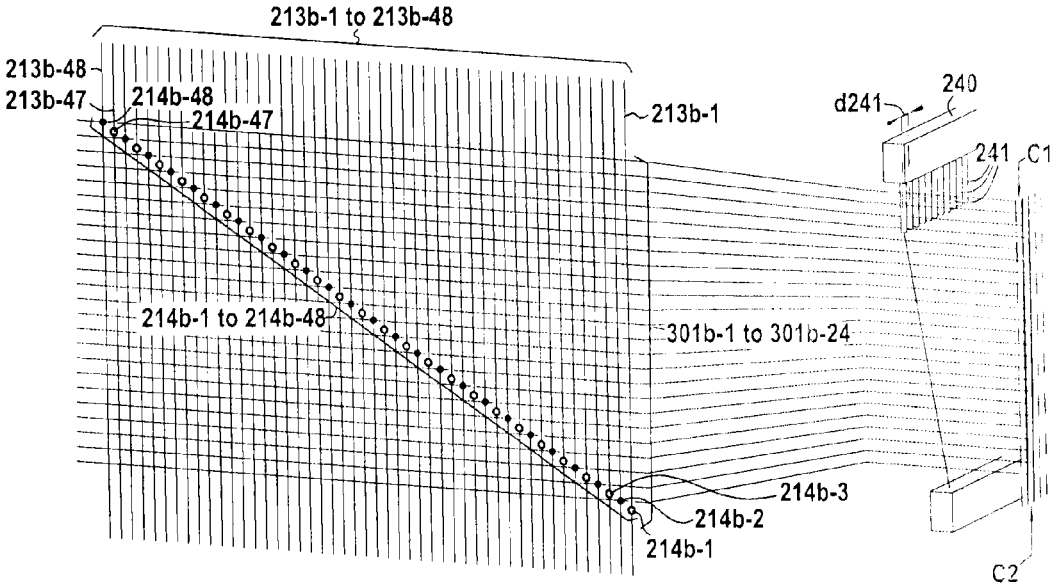

FIG. 7 shows how the warp yarns are distributed in the first column of heddles 213*b*-1 to 213*b*-48. The 24 warp yarns 301*b*-1 to 301*b*-24 pass through respective heddle eyes 214*b*-2, 214*b*-4, . . . to 214*b*-48 associated respectively with the heddles 213*b*-2, 213*b*-4, . . . , to 213*b*-48 so as to form the second column C2 of warp yarns in the shed.

Figure 8:
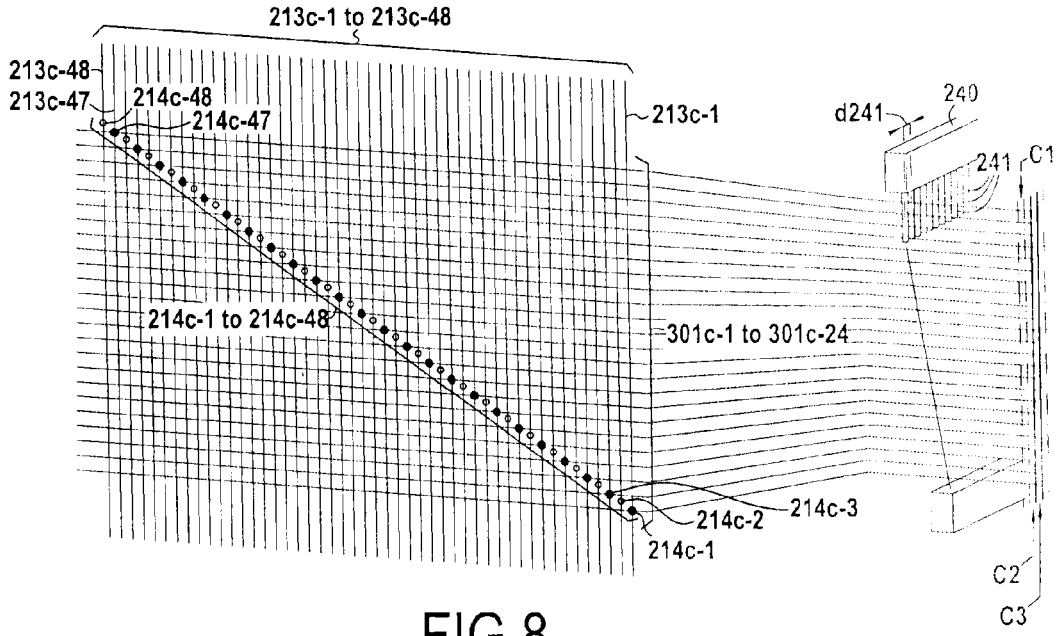

FIG. 8 shows how the warp yarns are distributed in the first column of heddles 213*c*-1 to 213*c*-48. The 24 warp yarns 301*c*-1 to 301*c*-24 pass through respective heddle eyes 214*c*-1, 214*c*-3, . . . to 214*c*-47 associated respectively with the heddles 213*c*-1, 213*c*-3, . . . , to 213*c*-47 so as to form the third column C2 of warp yarns in the shed.

Figure 9:
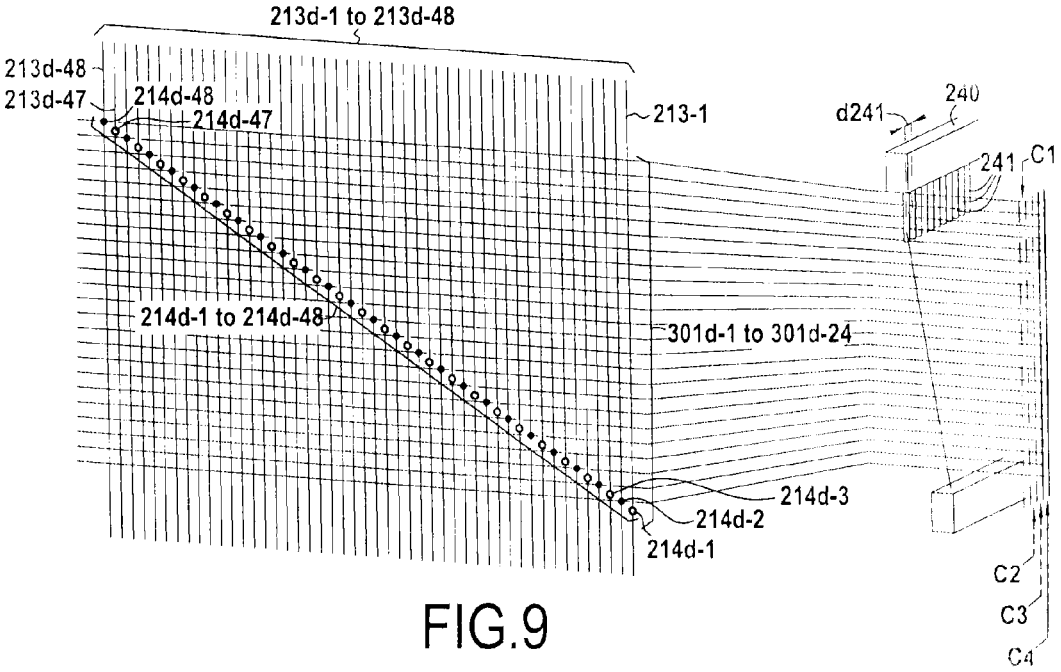

FIG. 9 shows how the warp yarns are distributed in the fourth column of heddles 213*d*-1 to 213*d*-48. The 24 warp yarns 301*d*-1 to 301*d*-24 pass through respective heddle eyes 214*d*-2, 214*d*-4, . . . to 214*d*-48 associated respectively with the heddles 213*d*-2, 213*d*-4, . . . , to 213*d*-48 so as to form the fourth column C4 of warp yarns in the shed.

The table below shows how the warp yarns are taken in the harness.

| Heddle eye | 1st column in the harness | Heddle eye | 2nd column in the harness | Heddle eye | 3rd column in the harness | Heddle eye | 4th column in the harness |
|---|---|---|---|---|---|---|---|
| 214a-48 | | 214b-48 | 301b-24 | 214c-48 | | 214d-48 | 301d-24 |
| 214a-47 | 301a-24 | 214b-47 | | 214c-47 | 301c-24 | 214d-47 | |
| 214a-46 | | 214b-46 | 301b-23 | 214c-46 | | 214d-46 | 301d-23 |
| 214a-45 | 301a-23 | 214b-45 | | 214c-45 | 301c-23 | 214d-45 | |
| 214a-44 | | 214b-44 | 301b-22 | 214c-44 | | 214d-44 | 301d-22 |
| 214a-43 | 301a-22 | 214b-43 | | 214c-43 | 301c-22 | 214d-43 | |
| 214a-42 | | 214b-42 | 301b-21 | 214c-42 | | 214d-42 | 301d-21 |
| 214a-41 | 301a-21 | 214b-41 | | 214c-41 | 301c-21 | 214d-41 | |
| 214a-40 | | 214b-40 | 301b-20 | 214c-40 | | 214d-40 | 301d-20 |
| 214a-39 | 301a-20 | 214b-39 | | 214c-39 | 301c-20 | 214d-39 | |
| 214a-38 | | 214b-38 | 301b-19 | 214c-38 | | 214d-38 | 301d-19 |
| 214a-37 | 301a-19 | 214b-37 | | 214c-37 | 301c-19 | 214d-37 | |
| 214a-36 | | 214b-36 | 301b-18 | 214c-36 | | 214d-36 | 301d-18 |
| 214a-35 | 301a-18 | 214b-35 | | 214c-35 | 301c-18 | 214d-35 | |
| 214a-34 | | 214b-34 | 301b-17 | 214c-34 | | 214d-34 | 301d-17 |
| 214a-33 | 301a-17 | 214b-33 | | 214c-33 | 301c-17 | 214d-33 | |
| 214a-32 | | 214b-32 | 301b-16 | 214c-32 | | 214d-32 | 301d-16 |
| 214a-31 | 301a-16 | 214b-31 | | 214c-31 | 301c-16 | 214d-31 | |
| 214a-30 | | 214b-30 | 301b-15 | 214c-30 | | 214d-30 | 301d-15 |
| 214a-29 | 301a-15 | 214b-29 | | 214c-29 | 301c-15 | 214d-29 | |
| 214a-28 | | 214b-28 | 301b-14 | 214c-28 | | 214d-28 | 301d-14 |
| 214a-27 | 301a-14 | 214b-27 | | 214c-27 | 301c-14 | 214d-27 | |
| 214a-26 | | 214b-26 | 301b-13 | 214c-26 | | 214d-26 | 301d-13 |
| 214a-25 | 301a-13 | 214b-25 | | 214c-25 | 301c-13 | 214d-25 | |
| 214a-24 | | 214b-24 | 301b-12 | 214c-24 | | 214d-24 | 301d-12 |
| 214a-23 | 301a-12 | 214b-23 | | 214c-23 | 301c-12 | 214d-23 | |
| 214a-22 | | 214b-22 | 301b-11 | 214c-22 | | 214d-22 | 301d-11 |
| 214a-21 | 301a-11 | 214b-21 | | 214c-21 | 301c-11 | 214d-21 | |
| 214a-20 | | 214b-20 | 301b-10 | 214c-20 | | 214d-20 | 301d-10 |
| 214a-19 | 301a-10 | 214b-19 | | 214c-19 | 301c-10 | 214d-19 | |
| 214a-18 | | 214b-18 | 301b-9 | 214c-18 | | 214d-18 | 301d-9 |
| 214a-17 | 301a-9 | 214b-17 | | 214c-17 | 301c-9 | 214d-17 | |
| 214a-16 | | 214b-16 | 301b-8 | 214c-16 | | 214d-16 | 301d-8 |
| 214a-15 | 301a-8 | 214b-15 | | 214c-15 | 301c-8 | 214d-15 | |
| 214a-14 | | 214b-14 | 301b-7 | 214c-14 | | 214d-14 | 301d-7 |
| 214a-13 | 301a-7 | 214b-13 | | 214c-13 | 301c-7 | 214d-13 | |
| 214a-12 | | 214b-12 | 301b-6 | 214c-12 | | 214d-12 | 301d-6 |
| 214a-11 | 301a-6 | 214b-11 | | 214c-11 | 301c-6 | 214d-11 | |
| 214a-10 | | 214b-10 | 301b-5 | 214c-10 | | 214d-10 | 301d-5 |
| 214a-9 | 301a-5 | 214b-9 | | 214c-9 | 301c-5 | 214d-9 | |
| 214a-8 | | 214b-8 | 301b-4 | 214c-8 | | 214d-8 | 301d-4 |
| 214a-7 | 301a-4 | 214b-7 | | 214c-7 | 301c-4 | 214d-7 | |
| 214a-6 | | 214b-6 | 301b-3 | 214c-6 | | 214d-6 | 301d-3 |
| 214a-5 | 301a-3 | 214b-5 | | 214c-5 | 301c-3 | 214d-5 | |
| 214a-4 | | 214b-4 | 301b-2 | 214c-4 | | 214d-4 | 301d-2 |
| 214a-3 | 301a-2 | 214b-3 | | 214c-3 | 301c-2 | 214d-3 | |
| 214a-2 | | 214b-2 | 301b-1 | 214c-2 | | 214d-2 | 301d-1 |
| 214a-1 | 301a-1 | 214b-1 | | 214c-1 | 301c-1 | 214d-1 | |

The warp yarns from the warp columns are deflected and organized by the comb 240 to match the numbers of columns and of layers of warp yarns that are defined for the fabric. Thus, for four columns of 48 heddles, the shed has four columns of 24 warp yarns, i.e. a first column of yarns 301*a*-1 to 301*a*-24, a second column of yarns 301*b*-1 to 301*b*-24, a third column of yarns 301*c*-1 to 301*c*-24, and a fourth column of yarns 301*d*-1 to 301*d*-24, thereby making it possible to obtain in the location where the warp yarns are woven with the weft yarns the density of warp yarns that is intended for the fabric.

In the example described with reference to FIGS. 6 to 9, the distance d241 between two adjacent teeth 241 of the comb 240 corresponds to the distance $d_h$ between two columns 2111 of holes 2110 in the comber board 211, and to the distance between two warp columns in the fabric divided by 2, four warp yarn columns being present between two adjacent teeth 121 of the comb 120.

The invention claimed is:

1. A jacquard loom for making a fabric by weaving a plurality of warp yarns with a plurality of weft yarns, the fabric including a determined number of columns of warp yarns per unit length and a determined number of layers of weft yarns, the loom comprising:

a comber board including a plurality of holes for passing a corresponding number of control cords, each control cord including an heddle eye through which a warp yarn passes, the holes in the comber board being distributed in a determined number of columns extending parallel to the warp yarn direction and a determined number of rows per column extending in a direction perpendicular to the warp yarn direction, wherein the comber board includes a number of columns of holes per unit length that is smaller than a number of warp columns in the same unit length in the fabric, and a number of rows of holes that is greater than the number of warp layers in the fabric.

2. A loom according to claim 1, wherein the number of columns of holes per unit length in the comber board is determined as a function of the number of warp columns in the same unit length in the fabric, and the number of rows of holes is determined as a function of the number of warp yarn layers in the fabric.

3. A loom according to claim 1, wherein the number of columns of holes in the comber board corresponds to the determined number of columns of warp yarns per unit length in the fabric divided by 1.5, and the number of rows of holes corresponds to the number of layers of warp yarns in the fabric multiplied by 1.5.

4. A loom according to claim 1, wherein the number of columns of holes in the comber board corresponds to the determined number of columns of warp yarns per unit length in the fabric divided by 2, and the number of rows of holes corresponds to the number of layers of warp yarns in the fabric multiplied by 2.

5. A loom according to claim 1, further comprising a comb located downstream from the control cords in a direction of advance of the warp yarns, and a spacing distance between two adjacent teeth of the comb corresponds to a distance that serves to pass a number of warp yarns between two teeth of the comb that corresponds to a divisor of the number of columns of holes per the unit length in the comber board and to a divisor of the number of warp columns per the unit length in the fabric.

6. A method of making reinforcing fiber structures with the loom of claim 1, comprising the step of making the reinforcing fiber structures for composite material blades of aeroengines.

* * * * *